US005823074A

United States Patent [19]

Ahlstone

[11] Patent Number: 5,823,074

[45] Date of Patent: Oct. 20, 1998

[54] OPEN HEAD FOSTER-STYLE BACK-UP TONG

[75] Inventor: Arthur Gustaf Ahlstone, Ventura, Calif.

[73] Assignee: Oil Country Manufacturing, Inc., Ventura, Calif.

[21] Appl. No.: 573,101

[22] Filed: Dec. 14, 1995

[51] Int. Cl.[6] ..... B25B 13/50

[52] U.S. Cl. ..... 81/57.34; 81/57.2

[58] Field of Search ..... 81/57.15, 57.16, 81/57.2, 57.18, 57.33, 57.34, 57.35

[56] References Cited

U.S. PATENT DOCUMENTS 3,380,324 4/1968 Hillman ..... 81/57.34 X
4,648,292 3/1987 Haynes et al. ..... 81/57.16
4,827,808 5/1989 Haynes et al. ..... 81/57.18
5,000,065 3/1991 Haynes ..... 81/57.33 X
5,172,613 12/1992 Wesch, Jr. ..... 81/57.33

*Primary Examiner*—D. S. Meislin
*Attorney, Agent, or Firm*—Natan Epstein; Beehler & Pavitt

[57] ABSTRACT

An open-head Foster style backup tong has a number of pivoting jaws in mesh with a ring gear. A gap in the ring gear admits tubing into the center of the ring gear, where the tubing is gripped by the jaws when the ring gear is turned. The tong housing is open sided for convenient access and maintenance, and the removable jaws are indexed for easy installation.

23 Claims, 5 Drawing Sheets

OPEN HEAD FOSTER-STYLE BACK-UP TONG

FIELD OF THE INVENTION

The present invention generally concerns tooling and equipment used in the maintenance and servicing of oil and gas production wells, and more particularly relates to a back-up tong of the type used in conjunction with a power tong to make or break threaded joints between successive tubing elements which make up the continuous tubing string extending through a well bore into the underground deposits.

STATE OF THE PRIOR ART

In an oil or gas production well tubing is lowered into the well bore to connect the underground deposit or production zone with the surface valves and related hardware which control the flow of oil and/or gas extracted from the well. The tubing string, which may have a total length of hundreds or thousands of feet, is assembled by joining successive tubing elements or sections which vary in length but typically may be thirty feet long. The ends of the tubing section are threaded with a male screw thread at one end and a female screw thread at an opposite end. As each tube section is lowered into the well bore a successive section is screwed to its upper end. Successive tube sections are joined in this manner until a string of sufficient length is made up to reach the underground deposit. The threaded joints between successive tube sections must be made with sufficient torque to provide a mechanical linkage and a pressure-tight seal which will not disengage or leak during the life of the tubing in the well bore.

Early in the development of oil well tooling regular pipe wrenches were used by well service personnel for this purpose. A first pipe wrench would be engaged to the tubing below a joint, and a second pipe wrench would be engaged to the tubing above the connection. The lower wrench, known as the back-up wrench, serves to prevent the pipe from turning when torque is applied by the upper wrench. The wrenches were, of course, oriented so that the jaws of the lower wrench react against the torque applied through the jaws of the upper wrench. That is, the upper and lower wrenches engage the tubing in mutually opposing orientation.

Over the past several decades simple wrenches have been replaced by various types of tubing tongs. First by manually operated tongs and later by power tongs operated by a pneumatic or hydraulic power source. Power tongs apply torque to the upper tubing of the joint while a pipe wrench or other static restraining device serves as the back-up device to keep the bottom tubing of the joint from rotating. Each tong has to be anchored to a static part of the oil rig to keep the tong from turning with the tubing. More recently the back-up device has been suspended from the power tong, so that the reaction torque of one is cancelled by the other tong, eliminating the need to anchor the tongs to the oil rig. Instead, the tong unit is merely suspended by a hoist over the well bore. In such arrangements, the tail end of the back-up device attaches to a structural support on the back end of the power tong. A second structural support holds the back-up device parallel to the power tong. Current designs also feature a swivel and hinge mounting of the back-up device which allows the back-up device to be lowered away from the power tong to permit rotation of the backup device by 180 degrees in relation to the tubing being assembled. This allows the back-up device to be flipped over according to the direction of rotation of the power tong so as to provide appropriate reactive force to the torque of the power tong.

Power tongs are available in two configurations, "open head" and "closed head". The closed head type tong has a through bore in the tong unit which admits the tubing in an axial direction, but the tong housing fully encompasses the tubing in a radial direction. As each new tubing section to be added to the string is stabbed into the top end of the tubing string, it is inserted through the center bore of the power tong. The power tong is positioned to engage the new tube section, while the back-up device engages the top section of the tubing string extending from the well bore. The operator then actuates the power tong to make or break the connection, i.e. the threaded joint. The power tong is set up to rotate only in one direction, either clockwise or counter-clockwise. If rotation must be reversed, for example, from making up a string of tubing to disassembling the string, the power tong and back-up device are removed from the tubing connection area and the power tong is adjusted to perform the opposite rotation. The back-up device is turned upside down in order to react to the now reversed torque of the power tong on the tubing joint. The open head configuration of power tong is similar to the closed head except in that the body of the tong has a radially extending slot which permits the power tong to move away from the tubing connection after making or breaking that connection. In such case the backup device must have a similar ability to open and to move away from the tubing. This tong configuration allows more room for service personnel to work around the tubing.

Various types of power tongs are known which differ in the design of the tube gripping mechanism. One type of power tong was developed and sold by the Foster Cathead Company of The Foster power tong was characterized by a ring gear mounted for rotation within a tong housing. The ring gear is toothed along both its inner and outer circumferences. A number of jaws inside the ring gear are pivoted to the housing. Each jaw has a radially outer arcuate toothed section in mesh with the ring gear and a radially inner jaw face grooved for gripping the surface of a tube positioned axially through the center of the ring gear. A drive gear powered by a hydraulic motor engages the outer circumference of the ring gear to turn the same. Rotation of the ring gear in one direction causes each of the jaws to pivot about its respective pivot point so as to swing the jaw faces towards the center of the ring gear and into gripping engagement with the tubing. Three or more such jaws engage the tubing in circumferentially spaced relationship. Further rotation of the ring gear in the same direction rotates the tubing along with the ring gear. This Foster-style gripping arrangement was subsequently adapted for use in a manually operated back-up tong. For this purpose, the ring gear was equipped with handles extending radially through the tong housing. Service personnel could manually turn the ring gear by means of these handles to engage or disengage the tong from the tubing.

While the Foster-style tongs work well for their intended purpose, no such tongs have been developed in an open head configuration to permit the back-up tong to separate from the tubing in a convenient manner so as to clear the work areas around the tubing when needed.

Power tongs have evolved to a considerable degree of refinement, while far less attention has been paid to improvement of back up tongs. These have remained relatively crude devices. The most commonly used back up device is the MS sold by the BJ Hughes (BJ Varco) Company. This back up has three links mounted at the end of a lever arm. The links wrap around a tube in a geometry such that the links tighten and grip the tube when torque is applied to the lever arm. This tong design is deficient in that the links contact a relatively small portion of the tube surface and tend to concentrate pressure so that at moderately high torque levels, 4,000 or 5,000 foot/lbs of torque, the tubing is indented by the links. Such deformation of the tubing away from its cylindrical shape may subsequently prevent passage of downhole tooling which is inserted through the tubing string to perform various maintenance and sampling operations at the well bottom. Other existing back-up tongs of open head configuration are equally problematic as they involve chains which must be wrapped around the tubing. In general, existing back up tongs of open head configuration require clumsy an time consuming handling. What is needed is a back-up tong of open head configuration which is quick and simple to operate, reliable, easy to maintain, and is effective at torques of up to 10,000 ft/lbs without damage to the tubing being assembled.

SUMMARY OF THE INVENTION

This invention addresses the aforementioned need by providing an open head Foster-style back-up tong for use in conjunction with a power tong to make or break threaded joints in strings of tubing. The novel back-up tong has a stem with an outer end for attachment to a supporting structure and an inner end, a tong housing supported at the inner end, a ring gear rotatable in the housing, a set of jaws pivoted to the housing and in mesh with the ring gear such that rotation of the gear in the housing is operative for pivoting the jaws between a retracted position and a gripping position. The back-up device according to this invention is characterized in that the annular continuity of the ring gear is interrupted by a gap which defines a radial aperture for admitting tubing into the center of the ring gear for engagement by the jaws. The gap may have a circumferential extent of less than one hundred twenty degrees of arc along the circumference of the ring gear. A radial slot may be defined in the housing, the gap in the ring gear being in alignment with the radial slot in an open position of said ring gear corresponding to the retracted position of the jaws. The ring gear is toothed along its interior circumference and is rotatably supported at its outer circumference between outer bearings mounted to the housing. Each of the jaws has a toothed end in mesh with the ring gear, an opposite end having a jaw face, and a pivot intermediate the toothed end and the opposite end. The housing has a pair of housing plates assembled in mutually parallel spaced apart relationship and the ring gear is contained between the plates. The housing plates may be held in spaced parallel relationship by bolts passing through corresponding spacer sleeves contained between the plates. The spacer sleeves may serve as the outer bearings around the ring gear. The housing is substantially open along all sides defined between the plates to discourage accumulation of debris in the housing and allow easy access for cleaning the housing interior. Each housing plate may be spaced from the ring gear to define therebetween a clearance space for further ease of removal of debris from between the ring gear and the plates. The clearance may be maintained by bolt heads of bolts inserted through the plates, the ring gear being axially supported between opposing sets of the bolt heads. Indexing holes in the jaws and the housing plates may be provided such that insertion of an alignment pin through the corresponding indexing holes positions the jaws in correct meshing engagement with the ring gear. A support assembly on the stem provides two degrees of freedom of movement of the tong relative to an external supporting structure. The tong is rotatable about a longitudinal axis of the stem, and is hinged along a hinge axis transverse to the stem axis at the support assembly for pendular movement to allow the tong head to swing down and away from an overlying supporting structure. One or more handles extend radially from the ring gear for use in application of manual torque to the ring gear. A fluid actuated drive element may be mounted to the tong housing and operatively connected for rotating the ring gear responsive to application of fluidic pressure to the drive element. The drive element may be a hydraulic actuator or a pneumatic actuator. Fluid conduits may be defined interiorly to the stem including an articulated fluidic coupling assembly containing internal conduits which remain in fluidic communication through a full range of relative positions of elements comprising the coupling assembly and the stem.

DETAILED DESCRIPTION OF THE PREFERRED EMBODIMENTS

Figure 1:
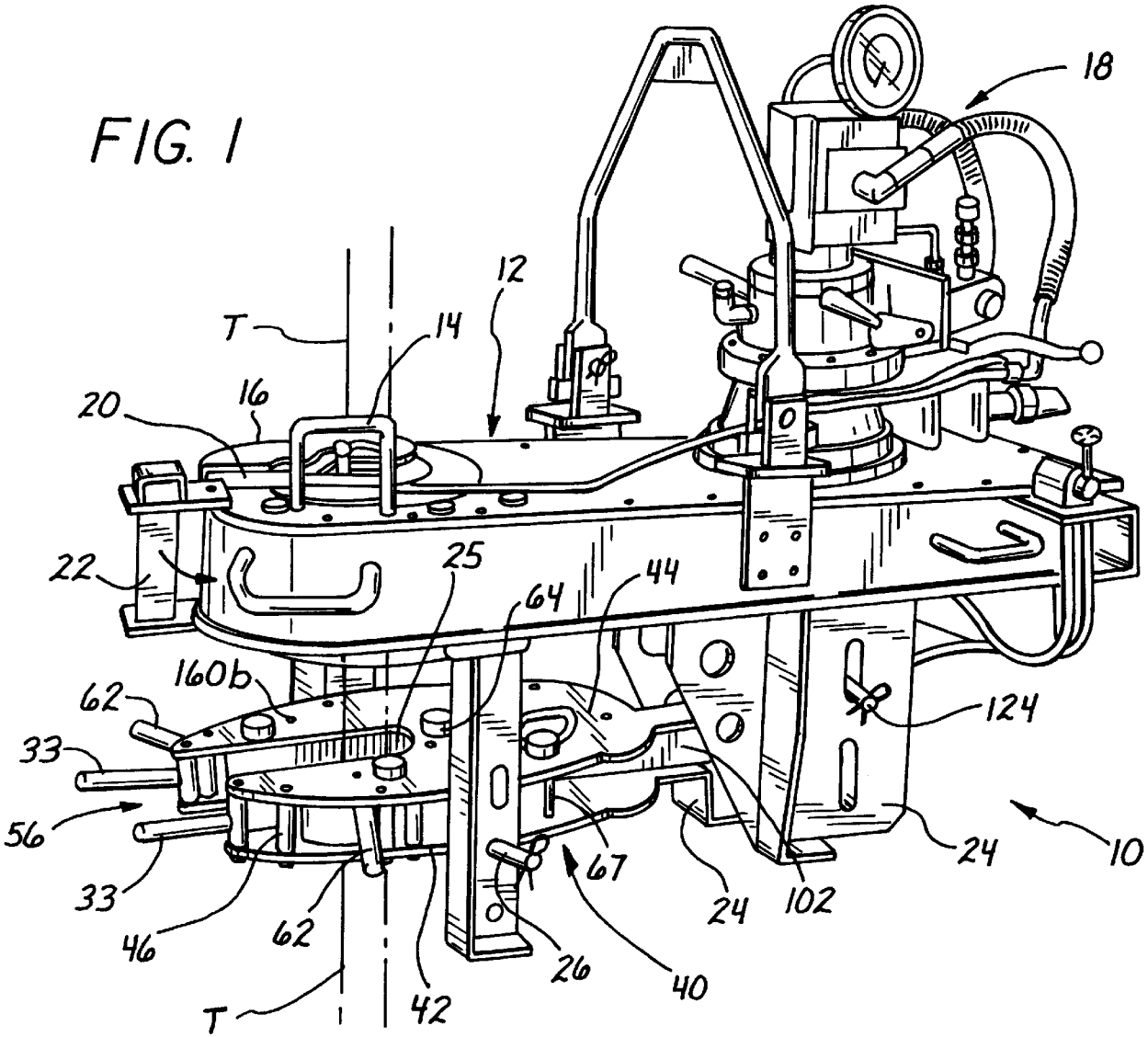
FIG. 1 is a perspective view of a typical prior art open head power tong combined with the novel open head back-up tong, with tubing captive in both tongs indicated in phantom lining.

With reference to the drawings, FIG. 1 shows a typical power tong/back-up tong combination generally designated by the numeral 10. The power tong 12 is of conventional design and has a through bore 14 in a tong head 16 which contains a hydraulically actuated tube gripping mechanism powered by hydraulic motor 18. The power tong is of open head configuration, having a radial slot 20 extending from the through bore 14 to the outside of the tong head. The slot 20 permits tubing T to be admitted laterally, i.e. in a radial direction, into the through bore 14. A hinged latch 22 closes the slot 20.

A back-up tong 40 according to the present invention is suspended underneath the power tong 12, and has a through bore axially aligned with the power tong through bore 14. A radial slot 56 opens the through bore 25 to the exterior of the back-up tong. The power tong 12 and back-up tong 40 are fixed by connecting structure against rotation relative to each other about their respective through bores. The unit 10 is positioned so that a joint in the tubing T is intermediate the power tong and the back-up tong. The back-up tong reacts against torque applied by the power tong to an upper tubing segment and transmitted to a lower tubing segment held in the back-up tong, so that the torques cancel each other within the structure of the unit 10.

Figure 2:
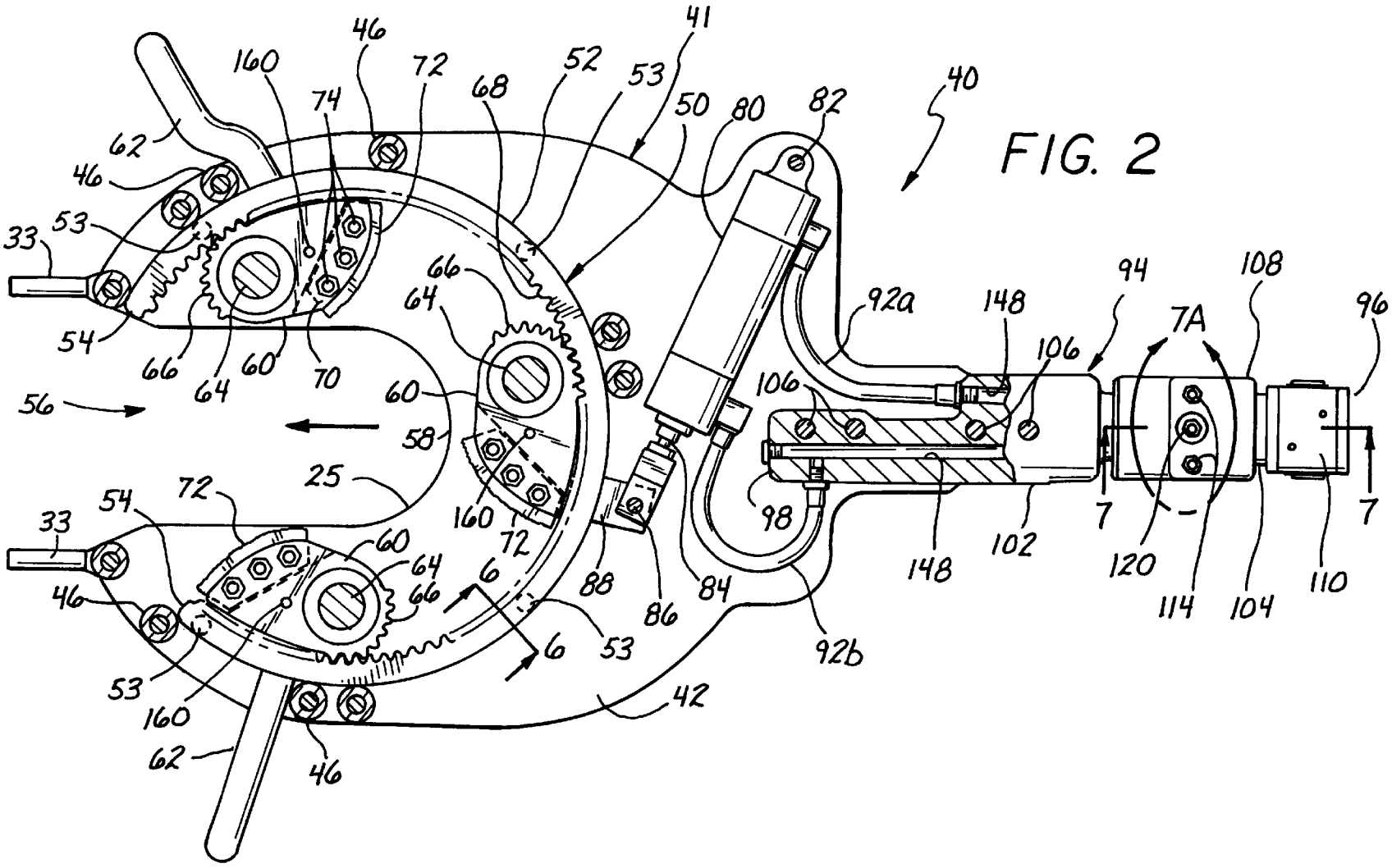
FIG. 2 is a top plan view of an open head back-up tong according to this invention with the top plate of the housing removed to expose the tube gripping mechanism shown in open or retracted position.

Turning now to FIG. 2 the open head back-up tong according to this invention is generally designated by the numeral 40, . The back-up tong 40 includes a tong head housing 41 which comprises a bottom plate 42, and a similarly shaped top plate 44 partially seen only in FIGS. 4 and 6. The two plates 42, 44 are generally planar and are assembled in mutually parallel spaced apart relationship by means of spacer sleeves 46 held in compression between the two plates by through-bolts 48 and retaining nuts 49, as best understood from FIG. 4. In FIG. 2, the top plate 44 has been removed to expose the tube gripping tong mechanism housed between the two parallel plates. The spacer sleeves 46 are arranged in a circular pattern but at irregular spacing from each other. A ring gear 50 has an outer circumference 52 which makes sliding tangential contact with the spacer sleeves 46. The circumferential continuity of the ring gear 50 is interrupted by a gap defined between two opposite gear ends 54. The extent of the gap in the illustrated embodiment is substantially lesser than 90 degrees of arc, and spans a radial slot 56 defined in each of the two parallel plates 42, 44. The slot 56 has a semi-circular inner edge 58 which is concentric with the ring gear 50. The ring gear turns freely about its center in sliding contact with the sleeves 46. Three jaws 60 are mounted on pivots 64. Each jaw has a toothed end 66 which is in mesh with the toothed inner circumference 68 of the ring gear. The opposite end of each jaw 60 carries a jaw insert 70 which defines a circularly curved jaw face 72. Each insert 70 is removably secured to the jaw 60 by means of three bolts 74. The angular range of movement of the ring gear is limited by the sleeves 46 on either side of a pair of radially projecting handles 62. Each handle 62 extends beyond the edge of the plates 42, 44 such that the exterior portion of the handles can be securely gripped by hand for applying torque to the ring gear. A pair of forward handles 33 may be attached on either side of the slot opening 56 for use in aligning the tong 40 with a tubing string to be work on.

Figure 3:
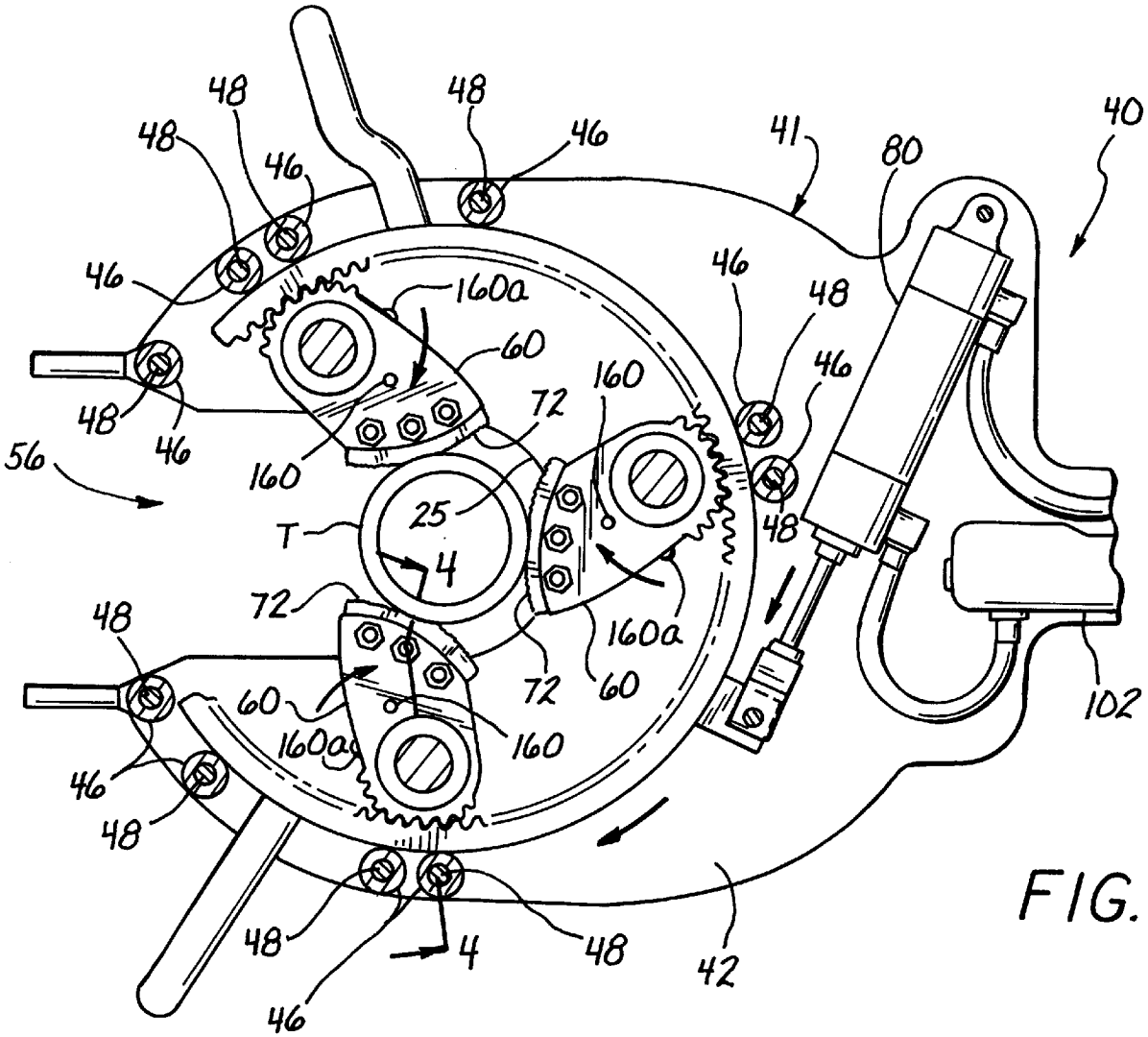
FIG. 3 is a view taken as in FIG. 2 but showing the tong mechanism in gripping position engaging a typical tube passing through the center of the mechanism.

In one form of the invention illustrated in FIGS. 2 and 3, the back-up tong 40 is equipped with a fluid actuated drive cylinder 80 which may be either hydraulically or pneumatically actuated. The cylinder 80 is secured at pivot 82 to the parallel plates 42, 44. An actuating rod 84 extends from the opposite end of the cylinder and is pivotably connected at 86 to a radial stub 88 extending from the ring gear 50. A pair of flexible hoses 92*a*, 92*b* connect the driver cylinder 80 to corresponding port connections on the tong stem 94. As will be explained below, the tong stem has internal fluidic conduits for connecting the driver cylinder 80 to a hydraulic or pneumatic control system. Pressurized fluid supplied to the cylinder 80 through one of the hoses causes the rod 84 to extend from the cylinder, thus applying torque to the ring gear 50 in a clockwise direction in FIG. 2. The ring gear responds to the torque by rotating relative to the housing plates 42, 44 to a position illustrated in FIG. 3. As the ring gear rotates, it causes each of the jaws 60 to turn in a clockwise direction about their respective pivots 64, moving the jaws from a retracted position in FIG. 2 to a gripping position shown in FIG. 3. A tube T placed in the slot 56 of the tong head and positioned concentrically with the ring gear 50 is engaged at three circumferentially spaced locations by the three jaw faces 72. Engagement of the tube T by the three jaw faces 72 occurs before the handles 62 reach their respective limiting spacer sleeves 46, so that rotation of the ring gear is limited instead by resistance of the tube T against further inward pivotal movement of the three jaws 60. The radially inward pressure against the tube T results in a radially outer reactive force on the jaws which is largely absorbed by the pivots 64 and transmitted to the housing plates 42, 44.

The ring gear 50 is circumferentially contained against spreading apart of its free ends 54 by the spacer sleeves 46. These are distributed about the ring gear circumference in pairs opposite to each of the pivots 64 of the three jaws 60. Each of these pairs backs up the ring gear against radially outward reactive force acting on the ring gear upon engagement of the jaws with a tube T. Additional unpaired spacer sleeves 46 serve as stops for the handles 62, as earlier explained, and to contain the ring ends 54 at the extreme limits of rotation of the ring gear. The spacer sleeves 46, each in cooperation with a corresponding through-bolt 48, thus serve the three functions of joining the parallel housing plates 42, 44; of centering the gear ring 50 about a center of rotation concentric with the circular slot end 58; and adding structural back-up to prevent the split ring gear 50 from spreading open under operating stress.

Figure 5:
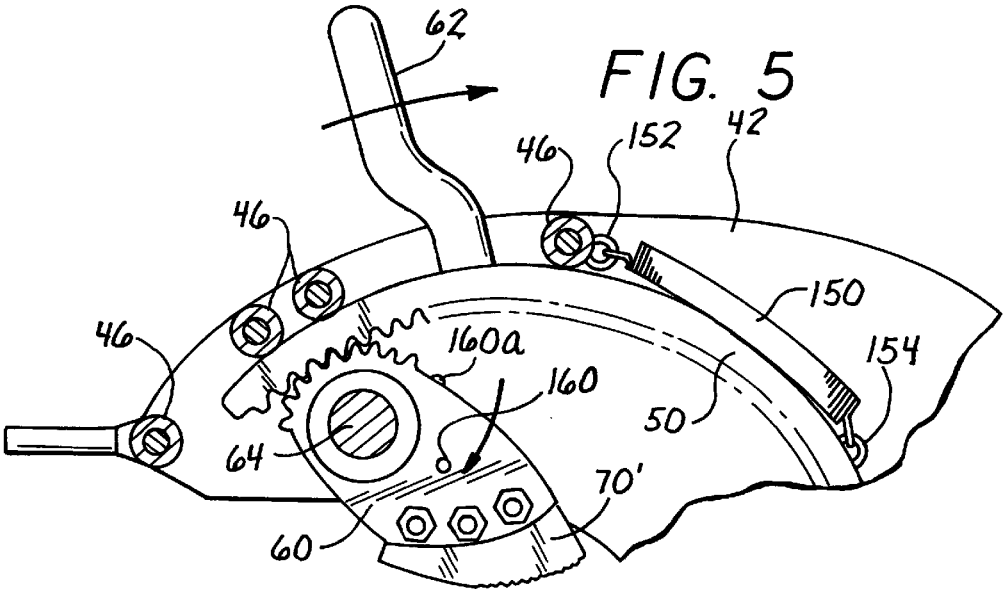
FIG. 5 is a fragmentary view as in FIG. 3 showing the optional use of a return spring between the ring gear and the housing to bias the tong mechanism to a normal retracted position, the mechanism being shown in locking position, and illustrating an alternate jaw insert for gripping smaller diameter tubing, the remaining jaws not shown in the figure having similar jaw inserts.

The jaw inserts 70 are sized and configured for gripping a range of tube diameters, for example, from 2 and ⅜ to 5 and 9/16" outside diameter. A second set of jaw inserts 70', one of which is illustrated in FIG. 5, is shaped so as to extend further in a radially inward direction towards the center of the ring gear for engaging a range of smaller diameter tubes, for example, 1.315 inches to 3.69 inches outside diameter. Two such sets of jaw inserts can cover substantially the entire range of tube diameters normally encountered in oil and gas well bores.

The stem 94 has an outer end 96 and an inner end 98 and includes a head block 102 from which extends an integral cylindrical stem tail 104. The block 102 is secured between the top and bottom housing plates 42, 44 by four bolts 106 which pass through both plates and the block 102. The block 102 thus serves as a further spacer element between the two plates of equal thickness with the spacer sleeves 46.

Figure 7A:
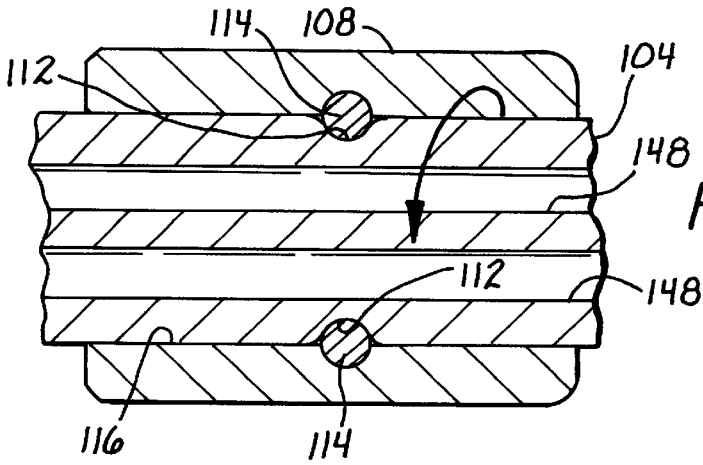
FIG. 7A shows a cross sectional view of the swivel mount on the stem taken along a plan perpendicular to the section of FIG. 7, and in the plane indicated by arrow 7A in FIG. 2.
Figure 7:
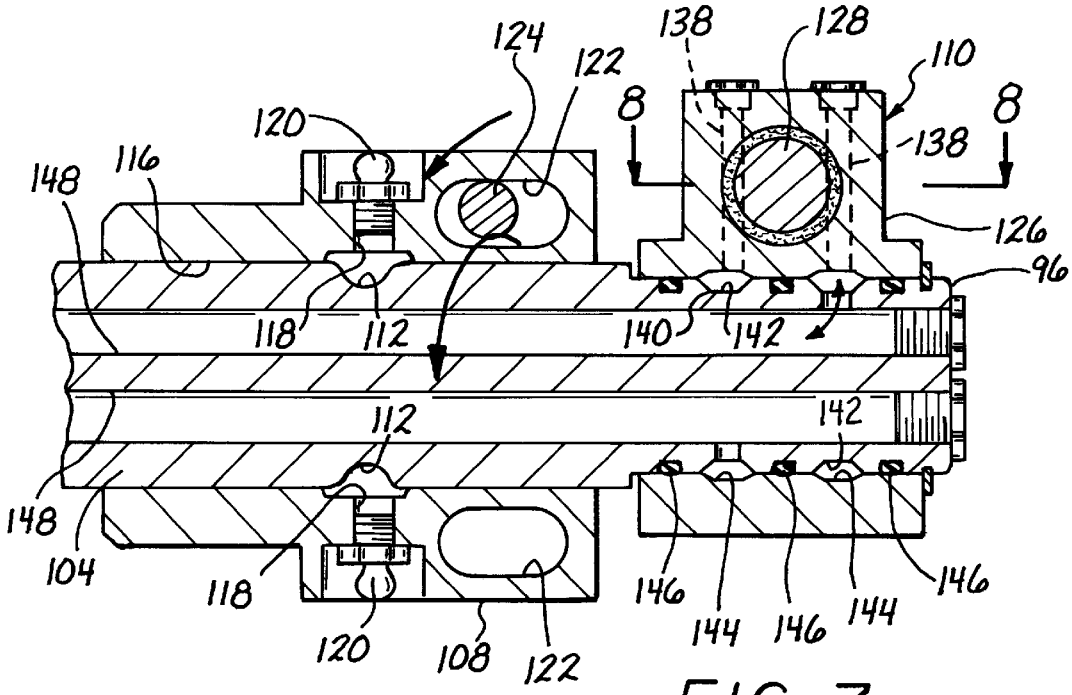
FIG. 7 shows the tail portion of the stem of the tong of FIG. 2 in longitudinal section and illustrates the combination hinge-swivel support of the stem and the articulated dual-axis fluidic coupling at the rear end of the stem.

Turning to FIG. 7, the stem tail 104 carries a suspension block 108 and an fluidic coupling assembly 110. The mounting block 108 is generally four-sided and has a large diameter longitudinal bore 116 which makes a close sliding fit about the stem tail 104. The stem 104 has an annular groove 112. A pair of bolts 114 pass through parallel bores in the block 108 which are perpendicular to the main bore 116, and are tangential with the annular groove 112, all as shown in FIG. 7A. The bolts 114 make tangential contact within the groove 112 and interlock the block 108 to the tail 104 in an axial direction, but permit the block 108 to turn freely about the cylindrical stem tail 104. The bolts 114 have bolt heads on one side of the block 108 and threaded ends engaged to retaining nuts on the opposite side of the block 108. The intermediate portions of the bolts 114 are smooth cylindrical shafts which slide tangentially about the circumference of the annular groove 112. Between the bolts 114 on opposite sides of the block 108 are grease injection ports 118 which open into the annular groove 112 and permit introduction of lubricant into this groove. These ports are normally closed by grease fittings 120.

The suspension block 108 also has two mutually parallel through-bores 122 of oval cross-section, seen in FIG. 7, which are perpendicular to the bolts 114. A suspension rod 124 passes through either one of the slots 122 and, as shown in FIG. 1, is supported between two skirt plates 24 affixed to the underside of the power tong 12 in the power tong/back-up tong combination unit 10. The tong head 41 is normally supported in generally horizontal position under the power tong on a removable support rod 26. The rod 124 provides a hinge mounting for the back-up tong 40, allowing the head end of the tong to swing down and away from the power tong after removal of the support rod 26. The suspension rod 124 is inserted through one or the other of the oval bores 122 so as to best level the back-up tong 40 under the power tong.

The suspension block 108 provides two degrees of freedom to the tong 40, i.e the entire tong 40 is free to turn about a longitudinal axis of the stem tail 104 relative to the suspension block 108. Furthermore, the suspension block 108 can pivot about the suspension rod 124 allowing the tong to swing through an arc in a vertical plane about a hinge axis transverse to the stem 94. The oval shape of the bores 122 allows the back-up tong 40 to be slightly adjusted in relation to the power tong as may be needed to properly engage the tubing T.

Figure 8:
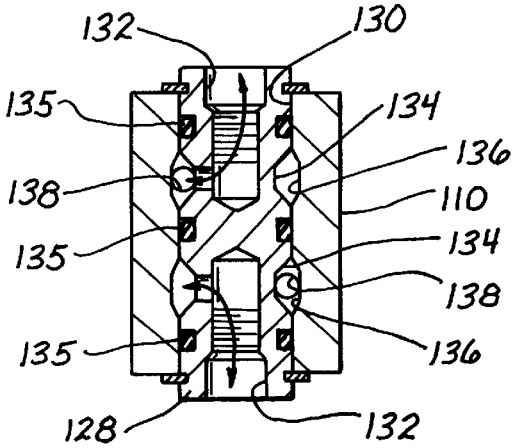
FIG. 8 is a longitudinal section taken along line 8—8 in FIG. 7 showing the articulated coupling of fluid conduits in the cylindrical hinge body and swivel block

With reference to FIG. 7, the articulated fluidic coupling assembly 110 includes a swivel block 126 which is mounted for rotation about the cylindrical stem tail 104 near the rear end 96. A cylindrical hinge body 128 has threaded ports 132 at its opposite ends and is fitted for rotation in a bore 130 of the swivel block 126. The bore 130 is transverse to the stem tail 104. The hinge body 128 has two axially spaced apart annular grooves 134 which are aligned with annular grooves 136 in the bore 130, defining two annular fluid conduits around the hinge body. Each threaded port 132 opens to a corresponding one of the annular grooves 134. Two parallel bores 138, shown in phantom lining in FIG. 7, pass through the swivel block 126, each bore 138 opening into a corresponding one of the annular conduits 134, as shown in FIG. 8. Seal rings 135 between the hinge body 128 and the swivel block 126 in bore 130 ensure against leakage from the annular conduits.

The swivel block 126 has a bore 140 which is closely sized to the outside diameter of the stem tail portion 104, and allows the fluidic coupling assembly 110 to swivel freely about the tong stem 94. Two annular grooves 142 in the stem tail 104 are axially aligned with corresponding annular grooves 144 in the bore 140 of the swivel block 126, defining annular conduits about the stem tail. The annular conduits are sealed from each other and the exterior environment by ring seals 146. Each bore 138 in the swivel block 126 opens into a corresponding one of the annular conduits 142 in the stem tail 104. In turn, each of the annular conduits 142 opens into a corresponding one of two longitudinal conduits 148 which run the length of the stem to the head end of the stem. Each hose 92*a*, 92*b* is connected to one of the conduits 148 at corresponding ports.

The flexible hoses 92*a*, 92*b*, and the actuator cylinder 80 are contained between the two housing plates 42, 44 and are well protected against damage from the abuse to which this type of tooling is typically subjected. The remainder of the fluid conduits extending the length of the stem are all internal to the stem components and are not exposed to damage. The fluidic coupling assembly 110 provides two degrees of axial freedom for the protected internal fluid conduits connecting the coupling ports 132 with the stem conduits 148, while maintaining fluidic continuity for any relative position between the hinge body 128, swivel block 126, and stem tail 104.

The back-up tong 40 is connected to a pressurized fluid pump and associated control valving 18 in FIG. 1 by means of external hoses, not shown in the drawings, connected to the two threaded ports 132 on the hinge body 128. One port 132 is connected to a source of pressurized fluid, at the high pressure side of a hydraulic or pneumatic pump, while the other port 132 is connected to the low pressure side of a hydraulic pump or vented to the atmosphere in the case of a pneumatic system, all through appropriate conventional control valving which enables service personnel to extend and retract the rod 84 of the drive cylinder 80 in order to open and close the jaws 60 of the tong by rotation of the ring gear 50 in one sense or the other. External hoses connected to the ports 132 are under little strain resulting from any movement of the tong 40 relative to the swivel block 126 and hinge body 128, as the latter two elements rotate about their corresponding axes to compensate for any movement of the stem 94, and do not transmit such movement to the connecting hoses.

Figure 6:
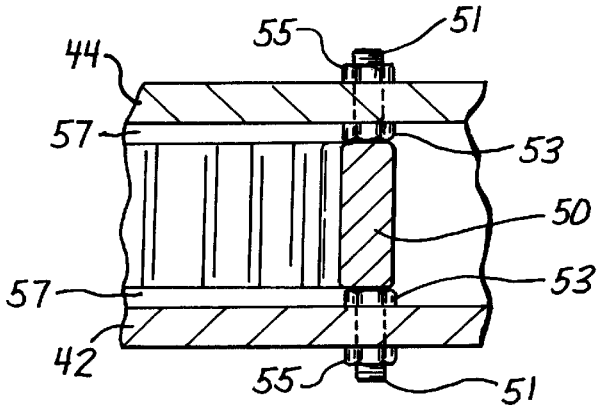
FIG. 6 is a fragmentary sectional view in elevation taken along line 6—6 in FIG. 2 showing the ring gear supported in spaced relationship to the top and bottom plates of the housing.

In one form of the invention, the height of the ring gear 50 is substantially smaller than the spacing between the housing plates 42, 44 as shown in FIG. 6. A pair of wear bolts or spacer bolts 51 are inserted in opposing alignment through the plates 42, 44 with the head 53 of each bolt on the interior side of the corresponding plate and in overlying relationship to the ring gear 50. Each bolt is secured in place by an outer nut 55. The bolt heads 53 serve as spacers to support the ring gear 50 in evenly spaced relationship to the housing plates and to create therebetween clearance spaces 57 which discourage compaction of dirt and debris between the ring gear and the housing plates, and facilitate cleaning of the tong mechanism by flushing or brushing out such debris from the clearance spaces 57. Four pairs of upper and lower bolts 51 are provided about the circumference of the ring gear 50, as indicated in FIG. 2 where the lower bolt heads 53 between the ring gear 50 and lower plate 42 are shown in phantom lining.

The back up tong 40 can be constructed in a manually operated embodiment by eliminating the drive cylinder 80 and associated hoses and fluid conduits. In such case, an optional return spring may be installed to bias the ring gear 50 to its open position of FIG. 2. Such a spring can be a coil spring 150 shown in FIG. 5 connected between a convenient spacer sleeve 46 at 152 and an attachment point 154 on the outer circumference of the ring gear, to bias the ring gear for counter-clockwise rotation in FIG. 5.

As best appreciated in FIG. 1 the tong head housing is comprised of the two plates 42, 44 joined at the spacer sleeves 46, and is essentially open and largely unobstructed along all sides between the two housing plates. The open construction of the tong housing minimizes accumulation of dirt and debris in the tong mechanism, and permits easy inspection and cleaning of the same.

Figure 4:
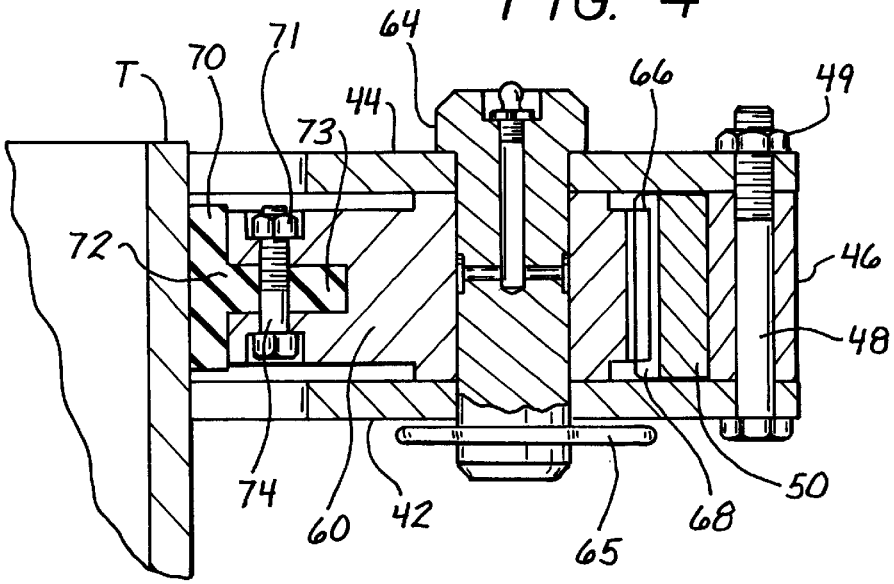
FIG. 4 is a fragmentary cross sectional view in elevation taken along line 4—4 in FIG. 3.

A further benefit of the open construction of the tong head housing is that removal and installation of the jaws 60, for example, for purposes of exchanging the jaw inserts 70, is greatly facilitated over previous Foster type tongs. Removal of the jaws 60 is easily accomplished as best understood by reference to FIG. 4. Each jaw 60 is held in place by the pivot pin 64 which is inserted through aligned pivot holes in the top and bottom plates 44, 42 and through the body of the jaw 60. The pivot 64 is held in place by a retaining clip 65 inserted transversely through the protruding lower end of the pivot exteriorly to the bottom plate 42. Removal of the jaw 60 merely involves extraction of the retaining pin 65 followed by removal of the pivot 64. This frees the jaw 60 from the top and bottom plates. The jaw can then be extracted from between the housing plates through the radial slot 56. The same procedure applies to each of the three jaws 60. Installation of the jaws is equally expedient. This procedure is facilitated by an indexing hole 160 provided in each jaw 60. The holes 160 align, in the open position of the jaws, with similar indexing holes in the top and bottom plates 42, 44. The indexing holes 160*a* in the bottom plate 42 are partially visible in FIGS. 3 and 5, and similarly positioned indexing holes 160*b* (only one of which is so designated in FIG. 1) are provided in the top plate 44. Each jaw is inserted between the top and bottom plates 42, 44 through the slot 56, and the jaw is positioned so as to align the indexing hole 160 with the corresponding alignment holes in the top and bottom housing plates. An indexing pin 67, seen in FIG. 1 inserted for storage in a convenient hole in the housing plates, is inserted into the indexing hole in the top plate 44. The jaw 60 is positioned until the pin 67 finds and passes through the indexing hole 160 in the jaw, after which the pin should pass without further difficulty into the corresponding indexing hole in the bottom plate 42. The indexing hole 160 is so located as to automatically position the toothed end 66 of the jaw for correct engagement with the ring gear 50 once the hole 160 is aligned with the indexing holed in the plates 42, 44. Installation of the jaw 60 is then completed by inserting the pivot pin 64 and retaining clip 65. The same installation procedure applies to each of the three jaws 60. The improved access to, and simplified removal and installation of the jaws minimizes the time and effort required to exchange the jaw inserts 70 for adapting the back up tong for larger or smaller diameter tubing. As best seen in FIG. 4, the insert 70 has a rear flange 73 which fits into a corresponding slot in the body of the jaw 60. Three bolts 74 pass through aligned holes in the jaw body and the flange 73, each bolt being retained by a nut 71. Exchanging the inserts after removal of the jaws from the tong 40 is quickly accomplished by removing the three bolts 74, exchanging the insert 70 and replacing the three bolts with their corresponding nuts 71.

While certain preferred embodiments of the invention have been described and illustrated for purposes of clarity and example, it should be understood that many changes, substitutions and modifications to the described embodiments will be readily apparent to those possessed of ordinary skill in the art without thereby departing from the spirit and scope of the present invention as defined in the following claims.

I claim:

1. A backup tong for use in making or breaking threaded joints in strings of tubing of oil and gas wells, comprising:

a stem having an outer end for attachment to a support and an inner end, a housing supported at said inner end, a ring gear rotatable in said housing, a plurality of jaws pivoted to said housing and in mesh with said gear such that rotation of said gear in said housing is operative for pivoting said jaws between a retracted position and a gripping position, each of said jaws having a toothed end in mesh with said ring gear and an opposite end having a jaw face, said jaw face being fixed in relation to said toothed end, said ring is toothed along an interior circumference thereof and is rotatably supported at an outer circumference thereof between a plurality of outer bearings mounted to said housing, said housing having a pair of plates rigidly interconnected by said outer bearings and said plates held against said outer bearings by bolts passing through both said plates and each of said outer bearings, said ring gear being contained between said plates, characterized in that the annular continuity of said ring gear is interrupted by a gap for admitting tubing into the center of said ring gear for engagement by said jaws.

2. The tong of claim 1 wherein said gap has a circumferential extent of less than one hundred twenty degrees of arc along the circumference of said ring gear.

3. The tong of claim 1 wherein said housing comprises a pair of plates assembled in mutually parallel spaced apart relationship and said ring gear is contained between said plates, said housing being substantially open along a continuous side edge defined between said plates thereby to discourage accumulation of debris therein and admit easy access for cleaning within said housing.

4. The tong of claim 3 wherein each said plate is spaced from said ring gear to define therebetween a clearance for ease of removal of debris from between the ring gear and said plates.

5. The tong of claim 4 wherein said clearance is maintained by bolt heads of bolts inserted through said plates, said ring gear being axially supported between opposing sets of said bolt heads.

6. The tong of claim 1 wherein said housing is rotatable about a longitudinal axis of said stem.

7. The tong of claim 1 wherein said housing is hingedly attached to said stem along a hinge line transverse to said stem.

8. The tong of claim 1 further comprising one or more handles affixed to said ring gear and extending radially therefrom, said handles having end portions exterior to said housing for use in application of manual torque to said ring gear.

9. The tong of claim 1 further comprising a fluid actuated drive element mounted to said housing and operatively connected for rotating said ring gear in said housing responsive to application of fluidic pressure to said drive element.

10. The tong of claim 9 wherein said drive element is a hydraulic actuator.

11. The tong of claim 9 wherein said drive element is a pneumatic actuator.

12. The tong of claim 1 further comprising a radial slot defined in said housing, said gap in said ring gear being in alignment with said radial slot in an open position of said ring gear corresponding to said retracted position of said jaws.

13. The tong of claim 1 wherein each of said outer bearings comprises a tubular sleeve and a bolt through said sleeve, said bolt passing through both said plates and a nut threaded on said bolt for holding said sleeve in compression between said plates.

14. The tong of claim 1 wherein said stem comprises a plurality of stem elements joined for movement relative to each other, further comprising fluid conduits defined in a plurality of said stem elements in communication with each other to define conduits continuous through said plurality of stem elements for any relative position of said stem elements, said conduits extending from said outer end to said inner end for interconnecting a fluid actuated element in said housing to a supply of pressurized fluid at said outer end.

15. The back-up tong of claim 1 further comprising a power tong having a tube receiving head attached to a stem, a through bore in said head, and a radial slot in said head for admitting tubing into said counter bore, said back-up tong being supported from said power tong with said ring gear in axial alignment with said through bore.

16. The back up tong of claim 1 wherein each of said jaws is pivoted to said housing on a corresponding pivot pin inserted through aligned pivot holes in said jaws and said housing, said jaws being removable from said housing upon removal of each said pivot pin from the pivot holes, and an indexing hole in each of said jaws and corresponding indexing holes in said housing located such that a pin inserted through corresponding ones of said indexing holes in each of said jaws and said housing positions said each of said jaws in correct meshing engagement with said ring gear and with the pivot holes in alignment for insertion of the pivot pin.

17. A backup tong for use in making or breaking threaded joints in strings of tubing of oil and gas wells, comprising:

a stem having an outer end for attachment to a support and an inner end, a housing supported at said inner end, a ring gear rotatable in said housing, a plurality of jaws pivoted to said housing and in mesh with said gear such that rotation of said gear in said housing is operative for pivoting said jaws between a retracted position and a gripping position, and a fluid actuated drive element mounted to said housing and operatively connected for rotating said ring gear in said housing responsive to application of fluidic pressure to said drive element, wherein said stem comprises a plurality of stem elements joined for movement relative to each other, further comprising fluid conduits defined in a plurality of said stem elements in communication with each other to define conduits continuous through said plurality of stem elements for any relative position of said stem elements, said conduits extending from said outer end to said inner end for interconnecting said fluid actuated element in said housing to a supply of pressurized fluid at said outer end.

18. The tong of claim 17 wherein said housing is rotatable about a longitudinal axis of said stem.

19. The tong of claim 17 wherein said housing is hingedly attached to said stem along a hinge line transverse to said stem.

20. The tong of claim 17 wherein said drive element is a hydraulic actuator.

21. The tong of claim 17 wherein said drive element is a pneumatic actuator.

22. A backup tong for use in making or breaking threaded joints in strings of tubing of oil and gas wells, comprising:

a stem having an outer end for attachment to a support and an inner end, a housing supported at said inner end, a ring gear rotatable in said housing, a plurality of jaws pivoted to said housing and in mesh with said gear such that rotation of said gear in said housing is operative for pivoting said jaws between a retracted position and a gripping position, wherein each of said jaws is pivoted to said housing on a corresponding pivot pin inserted through aligned pivot holes in said jaws and said housing, said jaws being removable from said housing upon removal of each said pivot pin from the pivot holes, and an indexing hole in each of said jaws and corresponding indexing holes in said housing located such that a pin inserted through corresponding ones of said indexing holes in each of said jaws and in said housing positions said each of said jaws in correct meshing engagement with said ring gear and with the pivot holes in alignment for insertion of the pivot pin.

23. The tong of claim 22 wherein each of said jaws has a toothed end in mesh with said ring gear and an opposite end having a jaw face, and said pivot pin is intermediate said toothed end and said opposite end.

* * * * *